US009546824B2

(12) United States Patent
Seo et al.

(10) Patent No.: US 9,546,824 B2
(45) Date of Patent: Jan. 17, 2017

(54) HEAT EXCHANGER

(75) Inventors: Kang Tae Seo, Suwon-si (KR); Hong Gi Cho, Suwon-si (KR); Hayase Gaku, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 883 days.

(21) Appl. No.: 13/317,731

(22) Filed: Oct. 27, 2011

(65) Prior Publication Data

US 2012/0103585 A1 May 3, 2012

(30) Foreign Application Priority Data

Oct. 28, 2010 (KR) ..... 10-2010-0106372

(51) Int. Cl.
*F28D 1/053* (2006.01)
*F28F 9/02* (2006.01)

(52) U.S. Cl.
CPC ..... *F28D 1/05391* (2013.01); *F28F 9/0204* (2013.01); *F28F 9/026* (2013.01); *F28F 9/0224* (2013.01); *F28F 9/0251* (2013.01); *F28F 9/0209* (2013.01); *F28F 9/0212* (2013.01)

(58) Field of Classification Search
CPC .... F28D 1/05391; F28F 9/0212; F28F 9/0209; F28F 9/0204
USPC ..... 165/176, 173
See application file for complete search history.

(56) References Cited

U.S. PATENT DOCUMENTS 4,998,580 A * 3/1991 Guntly et al. ..... 165/133
5,429,183 A * 7/1995 Hisamori et al. ..... 165/134.1
6,272,881 B1 * 8/2001 Kuroyanagi et al. ..... 62/525
6,341,648 B1 * 1/2002 Fukuoka et al. ..... 165/144
7,156,165 B2 * 1/2007 Ohata ..... F28F 9/0204 165/144
7,303,004 B2 * 12/2007 Iwasa et al. ..... 165/153
7,708,054 B2 * 5/2010 Watanabe et al. ..... 165/176
7,770,412 B2 * 8/2010 Ishizaka et al. ..... 62/500
8,201,620 B2 * 6/2012 Aung et al. ..... 165/173
2003/0066633 A1 * 4/2003 Lee et al. ..... 165/144
2005/0172664 A1 * 8/2005 Cho et al. ..... 62/515
2005/0247443 A1 * 11/2005 Kim ..... 165/176
2005/0268644 A1 * 12/2005 Oshitani et al. ..... 62/500
2006/0054310 A1 * 3/2006 Kim et al. ..... 165/110
2006/0162376 A1 * 7/2006 Higashiyama et al. ..... 62/515
(Continued)

FOREIGN PATENT DOCUMENTS

CN 1878003 12/2006
EP 0 802 383 A2 10/1997
(Continued)

OTHER PUBLICATIONS

Korean Office Action issued Jan. 17, 2014 in corresponding Korean Application No. 10-2010-0106372.
(Continued)

*Primary Examiner* — M. Alexandre Elve
*Assistant Examiner* — Joel Attey
(74) *Attorney, Agent, or Firm* — Staas & Halsey LLP

(57) ABSTRACT

A heat exchanger includes first and second heat exchanging units arranged between first and second header units, and a plurality of refrigerant circuits each defining a refrigerant path, through which refrigerant introduced into the first header unit is discharged out of the first header unit after exchanging heat in the first and second heat exchanging units.

18 Claims, 19 Drawing Sheets

(56) References Cited

U.S. PATENT DOCUMENTS

| | | | | |
|---|---|---|---|---|
| 2007/0062678 | A1* | 3/2007 | Hayashi et al. | 165/153 |
| 2007/0074861 | A1* | 4/2007 | Higashiyama | 165/174 |
| 2007/0163294 | A1* | 7/2007 | Aung et al. | 62/500 |
| 2007/0169512 | A1* | 7/2007 | Ishizaka et al. | 62/515 |
| 2007/0277964 | A1* | 12/2007 | Higashiyama et al. | 165/153 |
| 2009/0266528 | A1* | 10/2009 | Saito et al. | 165/153 |
| 2010/0031698 | A1* | 2/2010 | Higashiyama | 62/525 |
| 2010/0162749 | A1* | 7/2010 | Yoshimura et al. | 62/498 |

FOREIGN PATENT DOCUMENTS

| | | | |
|---|---|---|---|
| EP | 0 947 792 | A2 | 10/1999 |
| EP | 1 643 202 | A1 | 4/2006 |
| EP | 1 764 574 | A1 | 3/2007 |
| JP | 2001-294029 | | 10/2001 |
| JP | 2004-347210 | | 12/2004 |
| KR | 10-2007-0001076 | | 1/2007 |
| KR | 10-0812500 | | 3/2008 |
| KR | 10-0899946 | | 5/2009 |

OTHER PUBLICATIONS

Chinese Office Action issued Dec. 2, 2014 in corresponding Chinese Patent Application No. 201110340151.8.

European Search Report issued Jan. 15, 2015 in corresponding European Patent Application No. 11187108.3.

Chinese Decision on Grant dated Jun. 21, 2016 from Chinese Patent Application No. 201110340151.8, 8 pages.

European Office Action dated Oct. 10, 2016 from European Patent application No. 11187108.3, 48 pages.

* cited by examiner

HEAT EXCHANGER

CROSS-REFERENCE TO RELATED APPLICATIONS

This application claims the benefit of Korean Patent Application No. 10-2010-0106372 filed on Oct. 28, 2010 in the Korean Intellectual Property Office, the disclosure of which is incorporated herein by reference in its entirety.

BACKGROUND

1. Field

Embodiments of the present disclosure relate to a heat exchanger, and, more particularly, to a heat exchanger made of an aluminum material.

2. Description of the Related Art

An air conditioner is a system configured to control heat and humidity of ambient air. Heat exchange of such an air conditioner with ambient air is achieved by a simple refrigeration cycle.

The refrigeration cycle may include a compressor, a condenser, an expansion valve, and an evaporator. High-temperature and high-pressure refrigerant emerging from the compressor exchanges heat with outdoor air while passing through the condenser, so that it is changed into a low temperature state. The refrigerant is then changed into a low-temperature and low-pressure state while passing through the expansion valve. The low-temperature and low-pressure refrigerant subsequently exchanges heat with indoor air while passing through the evaporator, so that the indoor air is cooled.

Heat exchangers are classified into a heat exchanger for a vehicle and a domestic heat exchanger in accordance with the installation place thereof. The vehicle heat exchanger and domestic heat exchanger are different from each other in terms of the kind of refrigerant used therein and the operation environments of the installation place thereof such as air flow and air velocity. For this reason, these heat exchangers have different design factors in terms of material and size, in order to obtain optimal heat exchange efficiencies.

SUMMARY

It is an aspect of the present disclosure to provide a domestic heat exchanger made of an aluminum material.

It is another aspect of the present disclosure to provide a domestic heat exchanger which is made of an aluminum material, and has a structure capable of efficiently distributing refrigerant.

It is another aspect of the present disclosure to provide a domestic heat exchanger which is made of an aluminum material, and has a structure capable of securing a desired internal pressure of refrigerant.

It is another aspect of the present disclosure to provide a domestic heat exchanger which is made of an aluminum material, and has a structure capable of avoiding corrosion and securing desired stiffness.

It is still another aspect of the present disclosure to provide a domestic heat exchanger which is made of an aluminum material, and has a structure capable of achieving an enhancement in drainage performance.

In accordance with one aspect of the present disclosure, a heat exchanger includes a first header unit including a first header and a second header, a second header unit including a third header and a fourth header, a first heat exchanging unit arranged between the first header of the first header unit and the third header of the second header unit, and a second heat exchanging unit arranged between the second header of the first header unit and the fourth header of the second header unit, wherein each of the first header of the first header unit and the third and fourth header units of the second header unit is partitioned into a plurality of tanks by a plurality of partition plates, to define a plurality of refrigerant circuits, through which a plurality of refrigerant flows pass, and the second header of the first header unit is partitioned into a single tank by a plurality of partition plates, to allow refrigerant to flow in the second header of the first header unit in the form of a unified flow.

The first header of the first header unit may communicate with a plurality of refrigerant introduction pipes. The second header of the first header unit may communicate with a single refrigerant discharge pipe.

The refrigerant discharge pipe may be arranged at a longitudinal end of the first header unit.

The first and second headers of the first header unit, at which the refrigerant discharge pipe is arranged, may communicate with each other.

Each of the plural tanks in each of the first header of the first header unit and the third and fourth header units of the second header unit may be connected with a group of tubes included in the first heat exchanging unit.

Each of the plural tanks in the fourth header of the second header unit may be connected with a group of tubes included in the second heat exchanging unit. The single tank in the second header of the first header unit may be connected to an entirety of tubes included in the second heat exchanging unit.

The first header unit, the second header unit, the first heat exchanging unit and the second heat exchanging unit may be made of an aluminum material. The refrigerant introduction pipe may be made of a copper material.

A first connecting pipe made of a stainless steel material may be arranged between each of the plural refrigerant introduction pipes made of the copper material and the first header unit made of the aluminum material.

The first header unit, the second header unit, the first heat exchanging unit and the second heat exchanging unit may be made of an aluminum material. The refrigerant discharge pipe may be made of a copper material.

A second connecting pipe made of a stainless steel material may be arranged between the refrigerant discharge pipe made of the copper material and the first header unit made of the aluminum material.

The first and second header units may be horizontally arranged. The first and second heat exchanging units may be vertically arranged.

The first header unit may comprise a body having an intermediate barrier wall, and a cover coupled to the body, to divide the first header unit into the first and second headers.

The body may support the cover by outer and inner sides of the body in a simultaneous manner.

The second header unit may include a body having an intermediate barrier wall, and a cover coupled to the body, to divide the second header unit into the third and fourth headers.

A plurality of through holes may be formed through the intermediate barrier wall, to communicate the third and fourth headers with each other.

The body may support the cover by outer and inner sides of the body in a simultaneous manner.

Each of the tubes may include a plurality of microchannels.

Each of the heat exchanging units may include fins having a corrugated structure. Each of the fins may have louvers.

In accordance with another aspect of the present disclosure, a heat exchanger includes first and second header units, and first and second heat exchanging units arranged between the first and second headers, each of the first and second heat exchanging units including a plurality of fins and a plurality of tubes, wherein at least a portion of the first header unit is partitioned into a plurality of tanks respectively connected to a plurality of refrigerant introduction pipes, to allow refrigerant to flow in the first heat exchanging unit while forming a plurality of refrigerant blocks, wherein the second header unit is partitioned into a plurality of tanks to respectively define a plurality of connecting passages, so as to allow refrigerant to flow in the second heat exchanging unit while forming a plurality of refrigerant blocks, wherein at least a remaining portion of the first header unit is partitioned into a single tank connected to a single refrigerant discharge pipe.

The refrigerant discharge pipe may be arranged at a longitudinal end of the first header unit.

The first header unit may include a first header connected to the first heat exchanging unit, and a second header connected to the second heat exchanging unit. The first header of the first header unit may be partitioned into the plural tanks respectively connected to the refrigerant introduction pipes by a plurality of partition plates. The second header of the first header unit may be partitioned into the single tank connected to the refrigerant discharge pipe by a plurality of partition plates.

Each of the plural tanks in the first header of the first header unit may be connected to a group of tubes included in the plural tubes of the first heat exchanging unit. The tank in the second header of the first header unit may be connected to an entirety of the plural tubes of the second heat exchanging unit.

The second header unit may include a third header connected to the first heat exchanging unit, and a fourth header connected to the second heat exchanging unit. The third header of the second header unit may be partitioned into a group of tanks included in the plural tanks of the second header unit by a plurality of partition plates. Each of the tanks in the third header may be connected to a group of tubes included in the plural tubes of the first heat exchanging unit. The fourth header of the second header unit may be partitioned into a group of tanks included in the plural tanks of the second header unit by a plurality of partition plates. Each of the tanks in the fourth header may be connected to a group of tubes included in the plural tubes of the second heat exchanging unit.

The first header unit, the second header unit, the first heat exchanging unit and the second heat exchanging unit may be made of an aluminum material. The refrigerant introduction pipes and the refrigerant discharge pipe may be made of a copper material. A first connecting pipe made of a stainless steel material may be arranged between each of the refrigerant introduction pipe made of the copper material and the first header unit made of the aluminum material. A second connecting pipe made of a stainless steel material may be arranged between the refrigerant discharge pipe made of the copper material and the first header unit made of the aluminum material.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Hereinafter, a heat exchanger according to an exemplary embodiment of the present disclosure will be described with reference to the accompanying drawings.

The following description will be given in conjunction with a Kimchi refrigerator to store salted food, etc., as the refrigerator according to the embodiment of the present disclosure.

Figure 1:
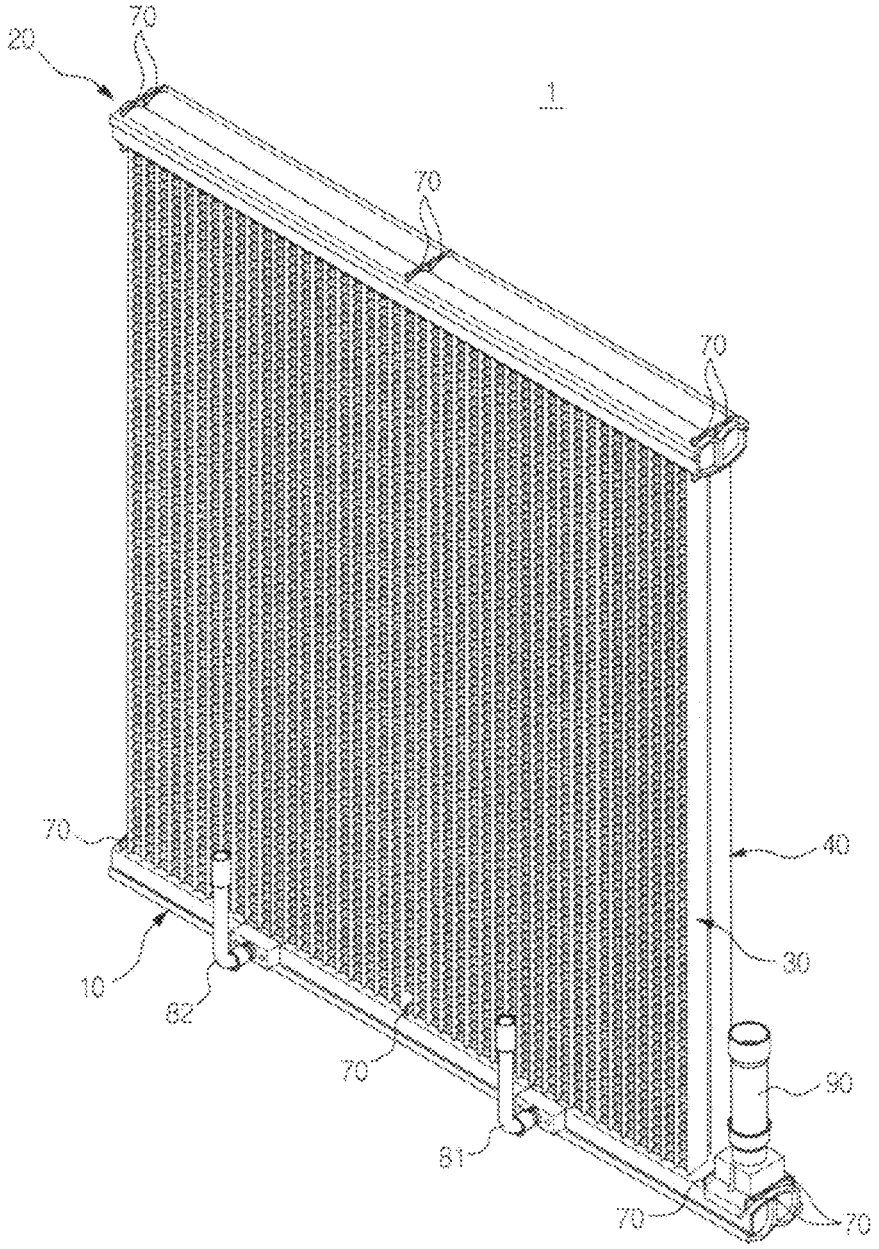
FIG. 1 is a perspective view illustrating a heat exchanger according to an exemplary embodiment of the present disclosure.

FIG. 1 is a perspective view illustrating a heat exchanger according to an exemplary embodiment of the present disclosure.

As shown in FIG. 1, the heat exchanger, which is designated by reference numeral 1, may be used to exchange heat with indoor air. In particular, the heat exchanger 1 may be an evaporator (or condenser) installed in a building. In this case, the heat exchanger 1 is distinguished from a heat exchanger installed in a vehicle. In the case of a heat exchanger installed in a vehicle, a refrigerant for a vehicle heat exchanger such as R-12 or R-134a (Maximum operating pressure only for cooling×3: 60-70 kg/cm$^2$) is used. In the case of the heat exchanger 1 shown in FIG. 1, however, a refrigerant for a domestic heat exchanger such as R-22 or R-410A (Maximum operating pressure for cooling/heating×3: 130-140 kg/cm$^2$) is used. The two heat exchangers have different shapes and structures in that they use different gas pressures because they use different kinds of refrigerant and have different functions, namely, a cooling function and a cooling/heating function, respectively. The following description will be given of the heat exchanger 1, which is made of an aluminum material and uses a refrigerant for a domestic air conditioner such as R-22 or R-410A.

The heat exchanger 1 includes a pair of header units 10 and 20, and a pair of heat exchanging units 30 and 40 arranged between the header units 10 and 20. The header units 10 and 20 are horizontally arranged, whereas the heat exchanging units 30 and 40 are vertically arranged. Hereinafter, the header unit 10, which is arranged at a lower position, is referred to as a first header unit, whereas the header unit 20, which is arranged at an upper position, is referred to as a second header unit. On the other hand, the heat exchanging unit 30, which is arranged at a front side, is referred to as a first heat exchanging unit, whereas the heat exchanging unit 40, which is arranged at a rear side, is referred to as a second heat exchanging unit.

Figure 2:
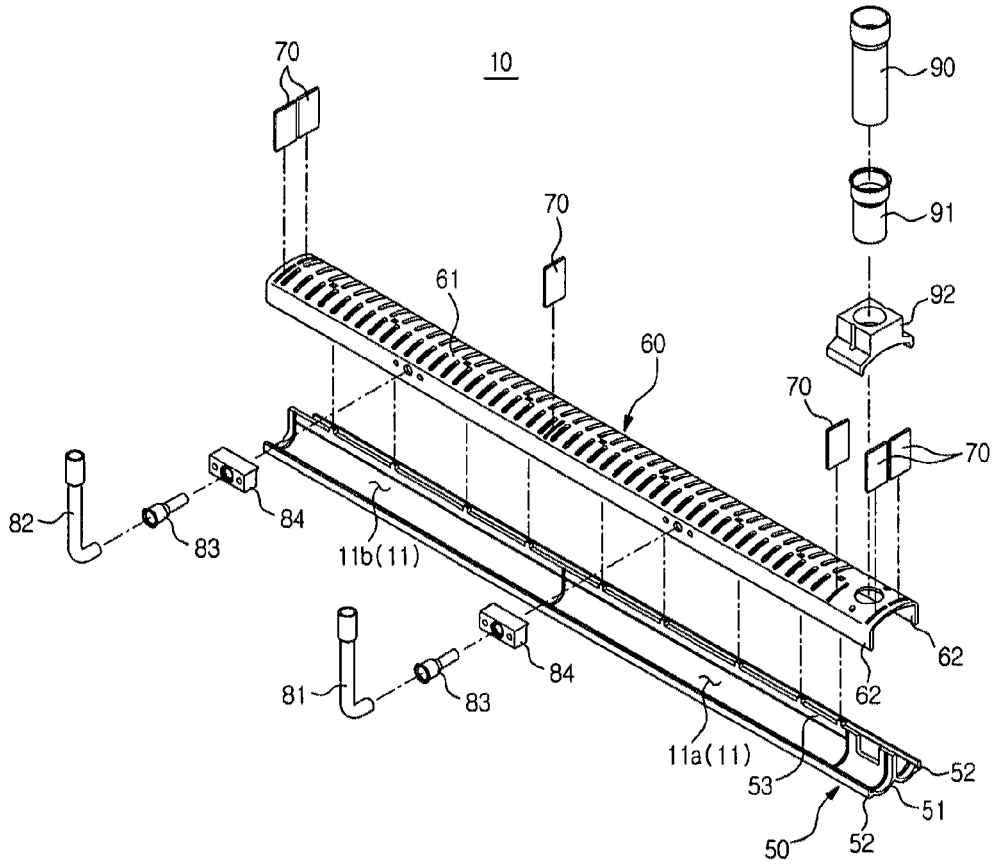
FIG. 2 is an exploded perspective view illustrating a structure of the first header unit according to an exemplary embodiment of the present disclosure.
Figure 3:
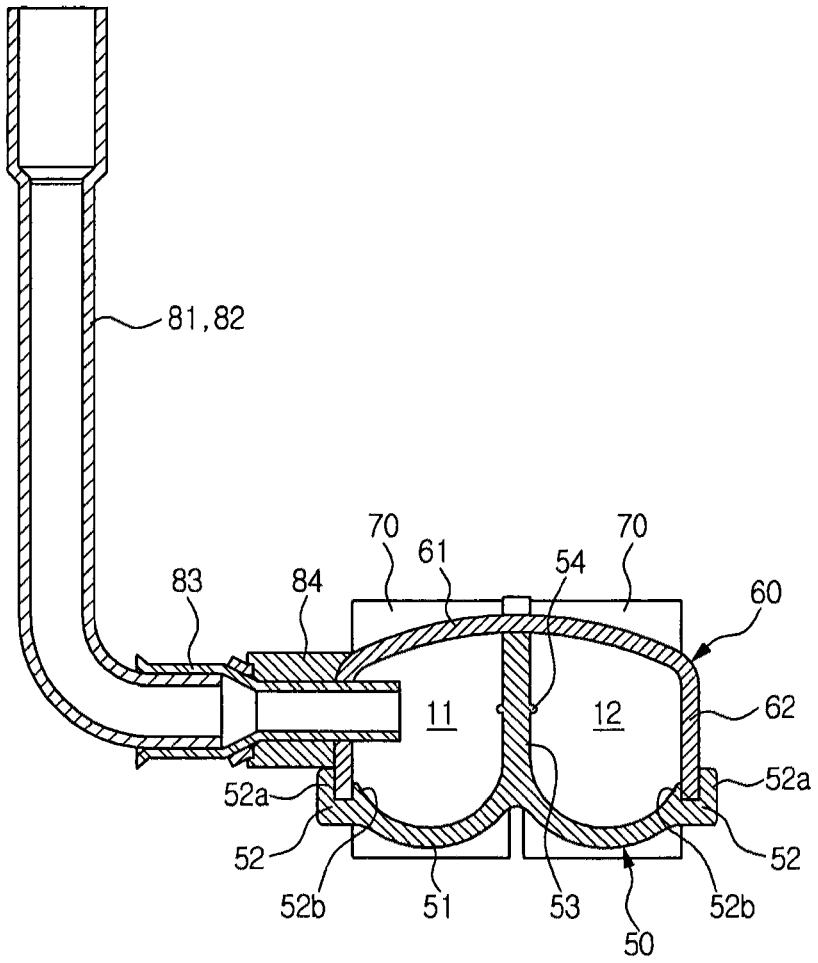
FIG. 3 is a sectional view illustrating a portion of the first header unit of FIG. 2 to which a refrigerant introduction pipe according to an exemplary embodiment of the present disclosure is coupled.
Figure 4:
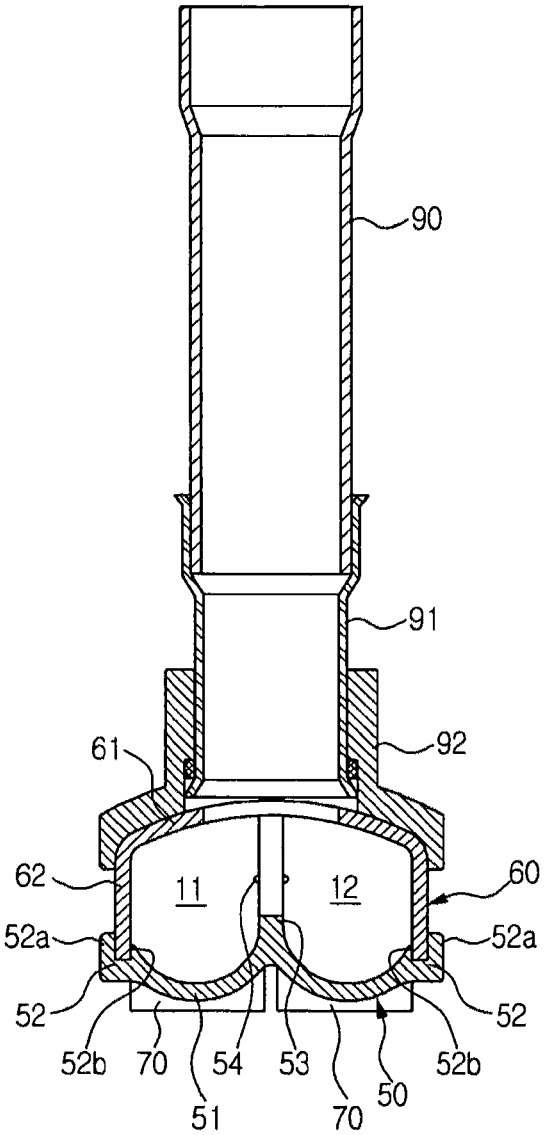
FIG. 4 is a sectional view illustrating a portion of the first header unit of FIG. 2 to which a refrigerant discharge pipe according to an exemplary embodiment of the present disclosure is coupled.
Figure 5:
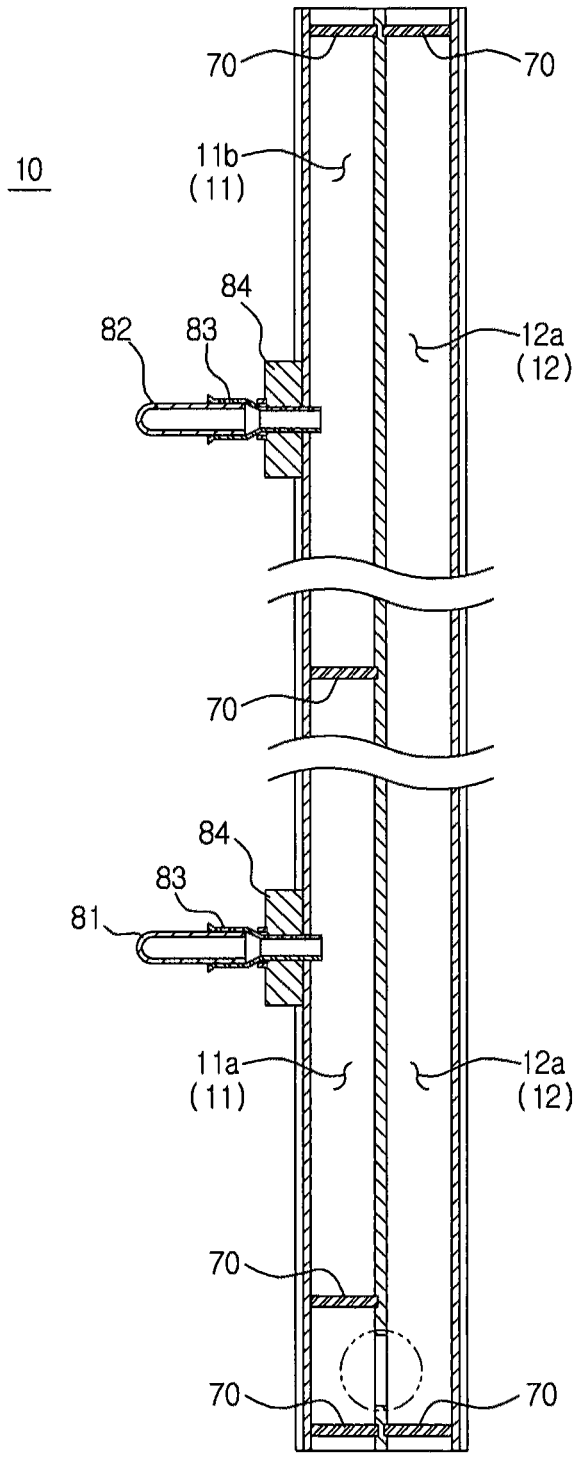
FIG. 5 is a sectional view illustrating a portion of the first header unit of FIG. 2 to which a partition plate according to an exemplary embodiment of the present disclosure is coupled.
Figure 6:
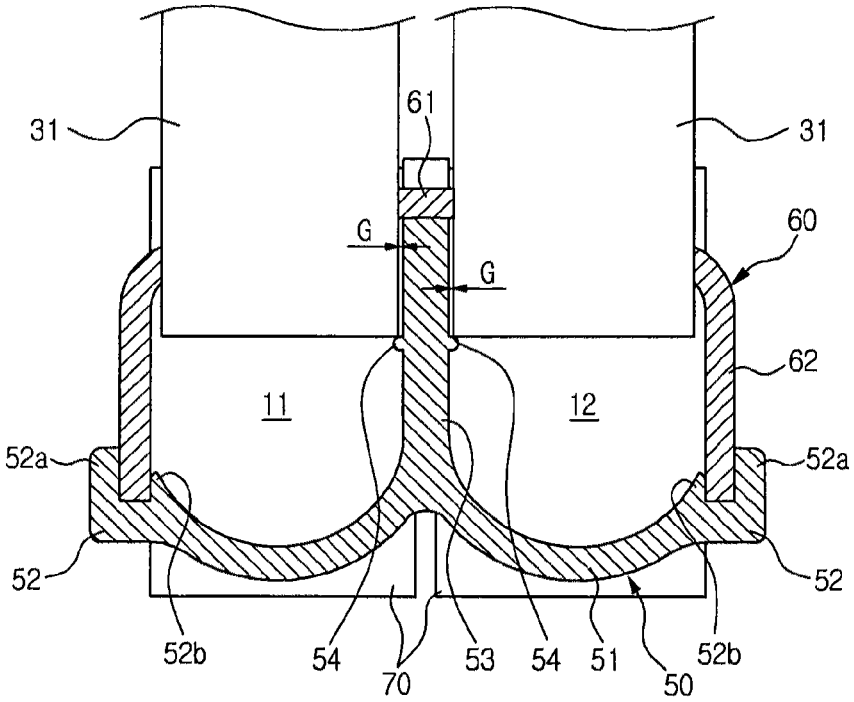
FIG. 6 is a sectional view illustrating a portion of the first header unit of FIG. 2 to which a tube according to an exemplary embodiment of the present disclosure is coupled.

FIG. 2 is an exploded perspective view illustrating a structure of the first header unit according to an exemplary embodiment of the present disclosure. FIG. 3 is a sectional view illustrating a portion of the first header unit of FIG. 2 to which a refrigerant introduction pipe according to an exemplary embodiment of the present disclosure is coupled. FIG. 4 is a sectional view illustrating a portion of the first header unit of FIG. 2 to which a refrigerant discharge pipe according to an exemplary embodiment of the present disclosure is coupled. FIG. 5 is a sectional view illustrating a portion of the first header unit of FIG. 2 to which a partition plate according to an exemplary embodiment of the present disclosure is coupled. FIG. 6 is a sectional view illustrating a portion of the first header unit of FIG. 2 to which a tube according to an exemplary embodiment of the present disclosure is coupled.

As shown in FIGS. 1 to 6, the first header unit 10 may include a body 50, a cover 60, and a plurality of partition plates 70.

The body 50 may be formed to substantially have a "ω" shape. In detail, the body 50 may include a base 51, seating grooves 52, an intermediate barrier wall 53, and stoppers 54.

The cover 60 may be formed to substantially have an "inverted U"-shape. In detail, the cover 60 may include a support portion 61 and side wall portions 62.

The intermediate barrier wall 53 of the body 50 is upwardly protruded from a central portion of the base 51 of the body 50, and is inserted into the support portion 61 of the cover 60. An upper end of the intermediate barrier wall 53 is outwardly protruded from the support portion 61, and is then coupled with the support portion 61 in a caulking fashion. Thus, the intermediate barrier wall 53 divides the first header unit 10 into a first header 11 and a second header 12, which are sealed from each other. In accordance with the caulking type coupling structure, it may be possible to secure desired stiffness against internal pressure of refrigerant between the intermediate barrier wall 53 and the support portion 61.

The side wall portions 62 of the cover 60 are structured to be fitted in respective seating grooves 52 of the body 50. That is, each seating groove 52 of the body 50 includes an outer side wall portion 52*a* and an inner side wall portion 52*b* to define a groove having a certain depth. Each side wall portion 62 is fitted between the outer and inner side wall portions 52*a* and 52*b* of the corresponding seating groove 52. Thus, the outer and inner side wall portions 52*a* and 52*b* of each seating groove 52 in the body 50 support outer and inner surfaces of a free end part of the corresponding side wall portion 62 in the cover 60, respectively. The outer side wall portion 52*a* is upwardly protruded to a higher level than the inner side wall portion 52*b*. Since the body 50 has a structure capable of supporting both the outer and inner surfaces of the cover 60, it may be possible to secure desired stiffness against the inner pressure of refrigerant.

Tubes 31 and tubes 41 are fitted in left and right side regions of the support portion 61 in the cover 60, respectively. Since the tubes 31 and 41 have the same structure, the following description will be given only in conjunction with the tubes 31 for simplicity of description. Each tube 31 is inserted into the support portion 61 until they come into contact with the corresponding stopper 54 formed at the intermediate barrier wall 53. Thus, the installation position of each tube 31 is set. Each tube 31 may be spaced apart from the intermediate barrier wall 53 by a predetermined gap G. The gap G maintained between the tube 31 and the intermediate barrier wall 53 before a brazing process may be 0.2 to 0.3 mm. This gap G is filled up by a clad material in the brazing process. As a result, the coupling force between the intermediate barrier wall 53 and the tube 31 increases, so that desired stiffness against the inner pressure of refrigerant may be secured.

Partition plates 70 are installed at opposite ends of the first header 11 to seal the first header 11. Another partition plate 70 is also installed at a central region of the first header 11. As a result, the first header 11 is partitioned into two tanks 11*a* and 11*b*. A group of tubes 31, which are included in the first heat exchanging unit 30, are connected to each of the first and second tanks 11*a* and 11*b*. Thus, refrigerant flows in the first header 11 in the form of a plurality of flows separated from one another by a plurality of partition plates 70.

Similarly, partition plates 70 are installed at opposite ends of the second header 12 to seal the second header 12. The second header 12 is partitioned into a single tank 12*a*. Accordingly, all tubes 41 of the second heat exchanging unit 40 are connected to the tank 12*a* of the second header 12. Thus, refrigerant flows in the second header 12 in the form of a unified flow. In this case, accordingly, it may be possible to simplify the overall structure and to reduce the manufacturing costs. In particular, the heat exchanger 1 may have a compact structure because the second header 12 communicates with a single refrigerant discharge pipe 90.

Meanwhile, an additional partition plate 70 is installed at the first header 11 adjacent to the partition plate 70 arranged at one end of the first header 11 (the right end in the illustrated case) while being spaced apart from the adjacent partition plate 70. The intermediate barrier wall 53 is partially removed in a region between the adjacent partition plates 70 of the first header 11 in order to allow a space defined between the adjacent partition plates 70 to communicate with the second header 12 (FIG. 4). The refrigerant discharge pipe 90 is connected to a portion of the first header unit 10 at which the first and second headers 11 and 12 communicate with each other through the removed portion of the intermediate barrier wall 53.

Each partition plate 70 is structured such that at least a portion thereof is fitted in the intermediate barrier wall 53. In accordance with this structure, it may be possible to increase the coupling force between the partition plate 70 and the intermediate barrier wall 53, thereby securing refrigerant sealing effects and achieving an increase in stiffness against internal pressure.

A plurality of refrigerant introduction pipes is installed at respective tanks of the first header 11. In the illustrated case, two refrigerant introduction pipes 81 and 82 are provided. In detail, the first refrigerant introduction pipe 81 is connected to the first tank 11*a* of the first header 11, whereas the second refrigerant introduction pipe 82 is connected to the second tank 11*b* of the first header 11. Practically, each of the refrigerant introduction pipes 81 and 82 is fitted through one side wall portion 62 of the cover 60 in the first header 11. A first connecting pipe 83 may be fitted between each of the refrigerant introduction pipes 81 and 82 and the side wall portion 62 of the cover 60. Since the refrigerant introduction pipes 81 and 82 are made of a copper material whereas the cover 60 is made of an aluminum material, the first connecting pipe 83, which is made of a stainless steel material, is interposed between each of the refrigerant introduction pipes 81 and 82 and the cover 60 in order to prevent promoted corrosion of the different materials (the copper and aluminum materials) that may occur when the copper and aluminum materials come into contact with each other.

A first reinforcing member 84 is provided at the side wall portion 62 of the cover 60 to support each of the refrigerant introduction pipes 81 and 82. Thus, each of the refrigerant introduction pipes 81 and 82 is firmly supported by the side wall portion 62 of the cover 60. The first reinforcing member 84 is made of an aluminum material. Accordingly, another first connecting pipe 83 is also provided between the first reinforcing member 84, which is made of an aluminum material, and each of the refrigerant introduction pipes 81 and 82, which are made of a copper material.

The refrigerant discharge pipe 90 is arranged in a region adjacent to the right ends of the first and second headers 11 and 12. In more detail, the refrigerant discharge pipe 90 is installed at a central region in the support portion 61 of the cover 60. Since the intermediate barrier wall 53 is partially removed from a region beneath the refrigerant discharge pipe 90, the first and second headers 11 and 12 communicate with each other in the region. The refrigerant discharge pipe 90 has a larger diameter than the refrigerant introduction pipes 81 and 82, in order to prevent loss of pressure caused by an increase in the volume of refrigerant occurring when the refrigerant is changed from a liquid phase to a gas phase during heat exchange. As a result, it may be possible to reduce the flow resistance of the refrigerant, and thus to allow the refrigerant to flow smoothly. Since only one refrigerant discharge pipe 90 is provided at one side of the first header unit 10, the heat exchanger 1 may have a compact structure.

A second connecting pipe 91 may be fitted between the refrigerant discharge pipe 90 and the support portion 61 of the cover 60. Since the refrigerant discharge pipe 90 is made of a copper material whereas the cover 60 is made of an aluminum material, the second connecting pipe 91, which is made of a stainless steel material, is interposed between the refrigerant discharge pipe 90 and the cover 60 in order to prevent promoted corrosion of the different materials (the copper and aluminum materials) that may occur when the copper and aluminum materials come into contact with each other.

A second reinforcing member 92 is provided at the support portion 61 of the cover 60 to support the refrigerant discharge pipe 90. Thus, the refrigerant discharge pipe 90 is firmly supported by the support portion 61 of the cover 60. The second reinforcing member 92 is made of an aluminum material. Accordingly, another second connecting pipe 91 is also provided between the second reinforcing member 92, which is made of an aluminum material, and the refrigerant discharge pipe 90, which is made of a copper material.

Figure 7:
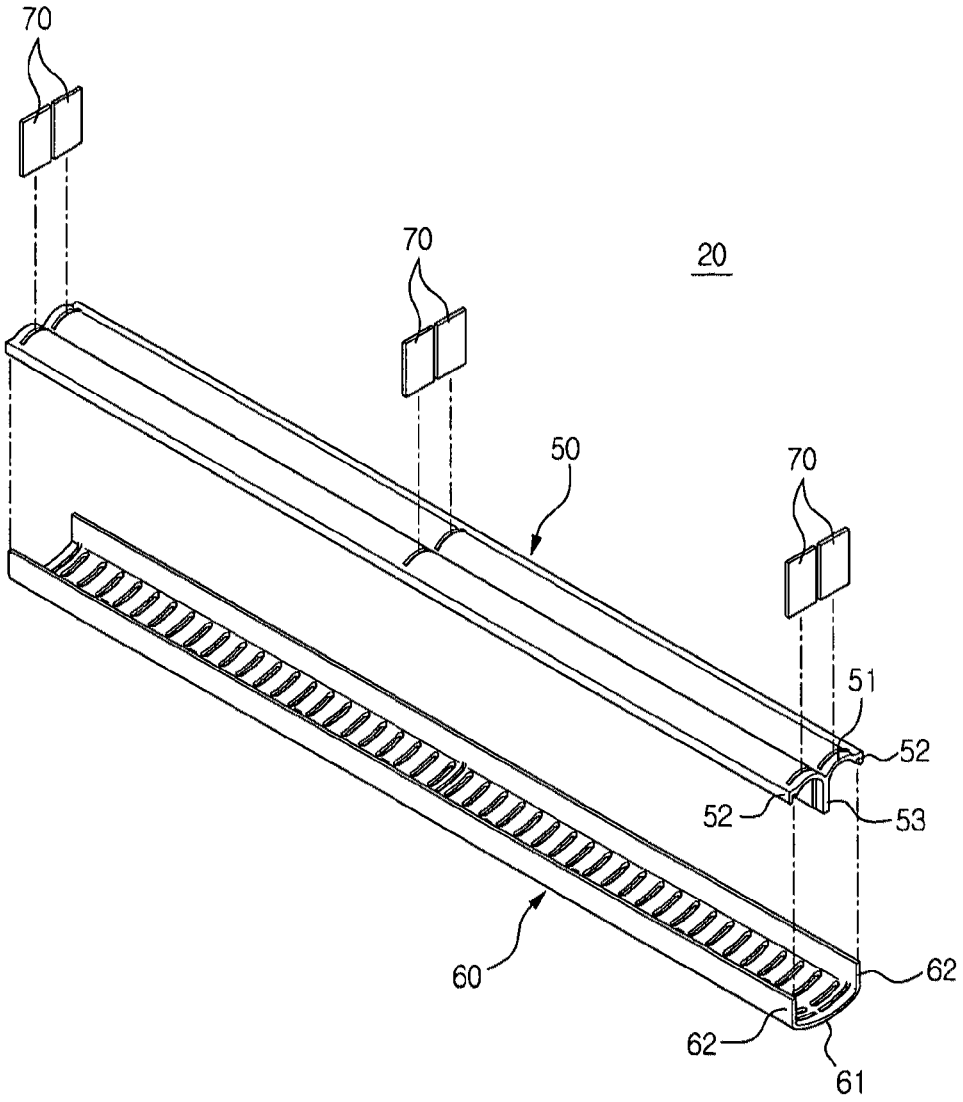
FIG. 7 is an exploded perspective view illustrating a structure of the second header unit according to an exemplary embodiment of the present disclosure.
Figure 8:
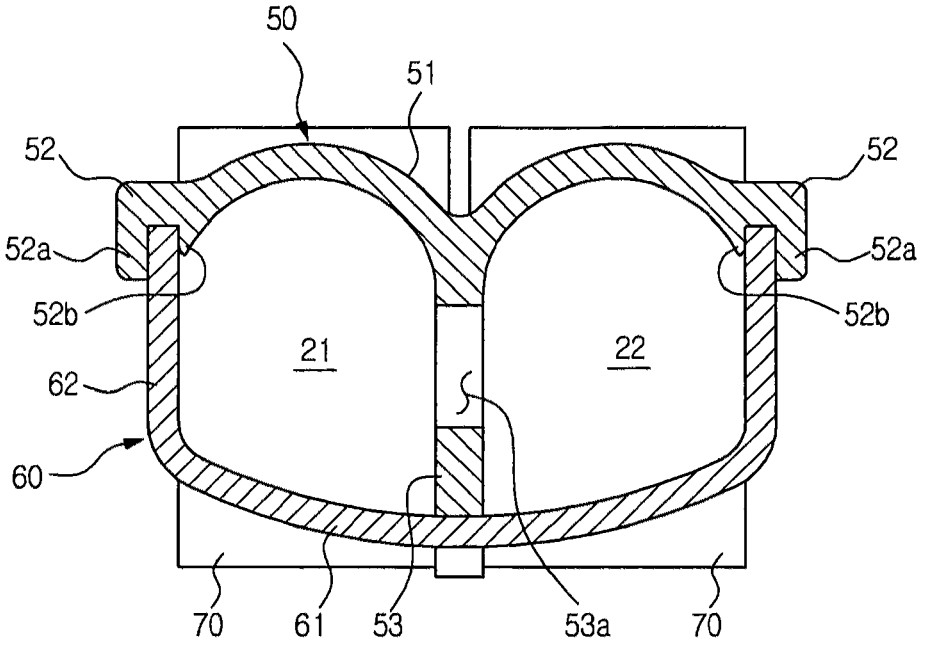
FIG. 8 is a sectional view illustrating a portion of the second header unit of FIG. 7 at which a through hole according to an exemplary embodiment of the present disclosure is formed.
Figure 9:
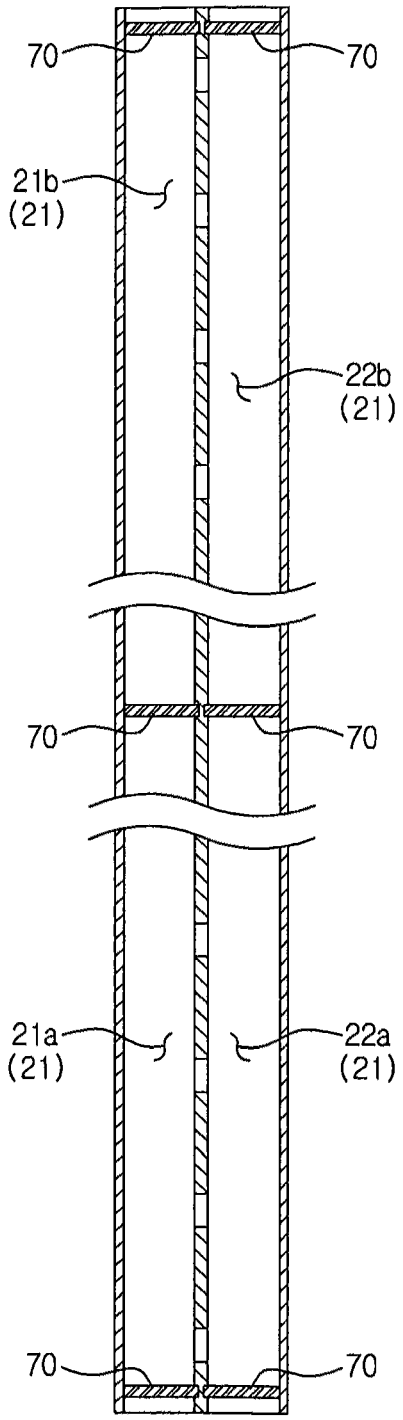
FIG. 9 is a sectional view illustrating a portion of the first header unit of FIG. 7 to which a partition plate according to an exemplary embodiment of the present disclosure is coupled.

FIG. 7 is an exploded perspective view illustrating a structure of the second header unit according to an exemplary embodiment of the present disclosure. FIG. 8 is a sectional view illustrating a portion of the second header unit of FIG. 7 at which a through hole according to an exemplary embodiment of the present disclosure is formed. FIG. 9 is a sectional view illustrating a portion of the first header unit of FIG. 7 to which a partition plate according to an exemplary embodiment of the present disclosure is coupled.

As shown in FIGS. 1 to 9, the second header unit 20 may include a body 50, a cover 60, and a plurality of partition plates 70.

The body 50 may be formed to substantially have a "ω" shape. In detail, the body 50 may include a base 51, seating grooves 52, an intermediate barrier wall 53, and stoppers 54. The cover 60 may be formed to substantially have a "inverted U"-shape. In detail, the cover 60 may include a support portion 61 and side wall portions 62. Hereinafter, the second header unit 20 will be described in conjunction with portions different from those of the body 50 and cover 60 in the first header unit 10, except for the same portions as the first header unit 10.

The intermediate barrier wall 53 of the body 50 divides the second header unit 20 into a third header 21 and a fourth header 22, which are sealed from each other. Of course, a plurality of through holes 53*a* is formed through the intermediate barrier wall 53 to be arranged in a longitudinal direction of the intermediate barrier wall 53. Accordingly, refrigerant may flow from the third header 21 to the fourth header 22 through the plural through holes 53*a*.

Partition plates 70 are installed at opposite ends of the third header 21 to seal the third header 21. Another partition plate 70 is also installed at a central region of the third header 21. As a result, the third header 21 is partitioned into two tanks 21*a* and 21*b*. A group of tubes 31, which are included in the first heat exchanging unit 30, are connected to each of the first and second tanks 21*a* and 21*b*. Thus, refrigerant flows in the third header 21 in the form of a plurality of flows separated from one another by a plurality of partition plates 70.

Similarly, partition plates 70 are installed at opposite ends of the fourth header 22 to seal the fourth header 22. Another partition plate 70 is also installed at a central region of the fourth header 22. As a result, the fourth header 22 is partitioned into two tanks 22*a* and 22*b*. A group of tubes 41, which are included in the second heat exchanging unit 40, are connected to each of the first and second tanks 22*a* and 22*b*. Thus, refrigerant flows in the fourth header 22 in the form of a plurality of flows separated from one another by a plurality of partition plates 70.

Thus, each of the third and fourth headers 21 and 22 is divided into a plurality of header portions defining a plurality of connecting passages to connect the first and second heat exchanging units 30 and 40.

Figure 10:
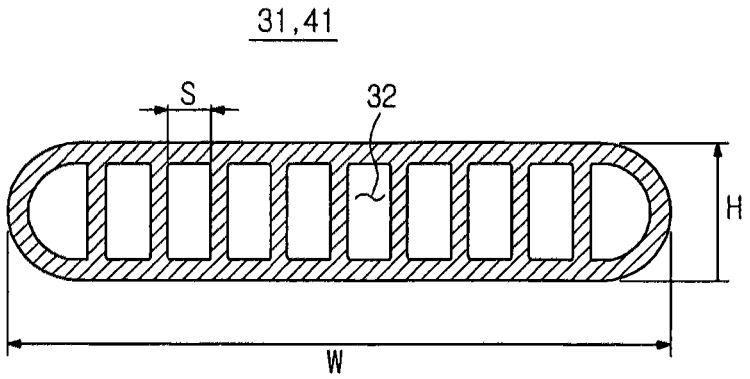
FIG. 10 is a sectional view illustrating tube structures of the first and second heat exchanging units according to an exemplary embodiment of the present disclosure.
Figure 11:
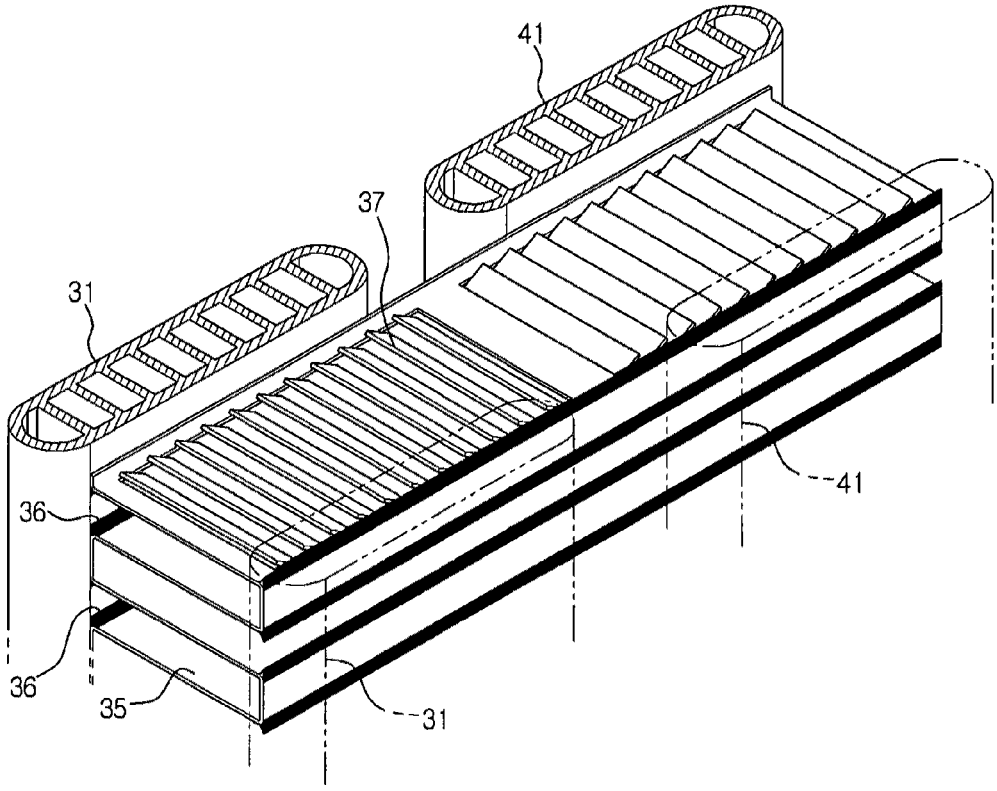
FIG. 11 is a perspective view illustrating fin structures of the first and second heat exchanging units according to an exemplary embodiment of the present disclosure.

FIG. 10 is a sectional view illustrating tube structures of the first and second heat exchanging units according to an exemplary embodiment of the present disclosure. FIG. 11 is a perspective view illustrating fin structures of the first and second heat exchanging units according to an exemplary embodiment of the present disclosure.

As shown in FIGS. 1 to 11, the first heat exchanging unit 30 may include a plurality of tubes 31 and fins 35, and the second heat exchanging unit 40 may include a plurality of tubes 41 and fins 35. Since the tubes 31 and 41 have the same structure, the following description will be given only in conjunction with the tubes 31, for simplicity of description.

Each tube 31 has a planar structure having a plurality of microchannels 32. The number of microchannels 32 in each tube 31 may be about 6 to 10. Each tube 31 may have a width W of 7 to 13 mm, and a height H of 2 to 3 mm. The spacing S between the adjacent microchannels may be 0.7 to 0.8 mm.

Each fin 35 is arranged between the adjacent tubes 31. Each fin 35 has a corrugated structure. In this case, the corrugated structure is formed by alternately and repeatedly bending the fin 35 through about 90° to form successive bent portions spaced apart from one another by a certain distance. That is, the fin 35 is structured to be perpendicularly protruded from the corresponding tubes 31. The fin 35 is coupled to the corresponding tubes 31 through a brazing process. In the brazing process, fillets 36 are formed at contact regions between the fin 35 and each tube 31.

Louvers 37 are formed at each fin 35. The louvers 37 function to enhance heat exchange efficiency and easy drainage. That is, the louvers 37 generate turbulent air flows to increase the contact time and area of the fin 35 with air, thereby achieving an enhancement in heat exchange efficiency. Also, the louvers 37 reduce the surface tension of condensed water, thereby achieving an enhancement in drainage performance.

Figure 12:
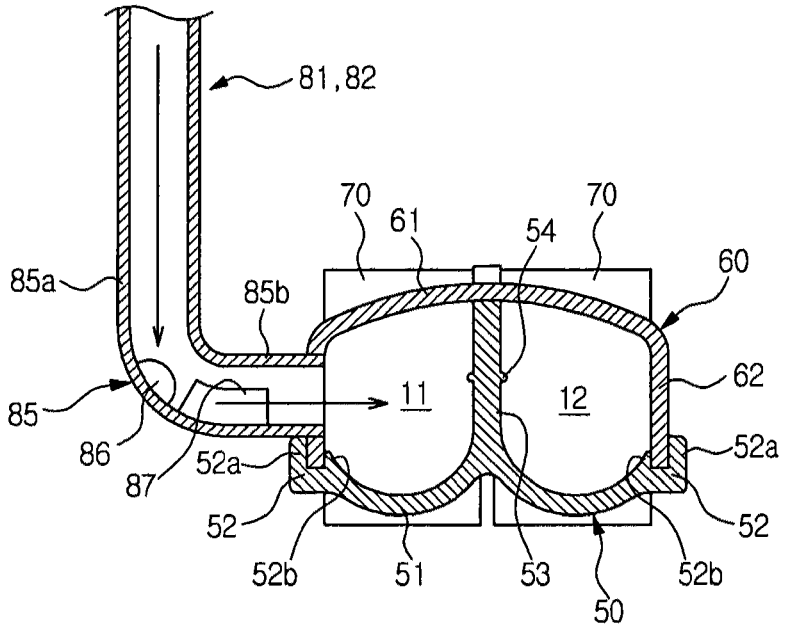
FIGS. 12 and 13 are sectional views illustrating a refrigerant introduction pipe according to another exemplary embodiment of the present disclosure.
Figure 13:
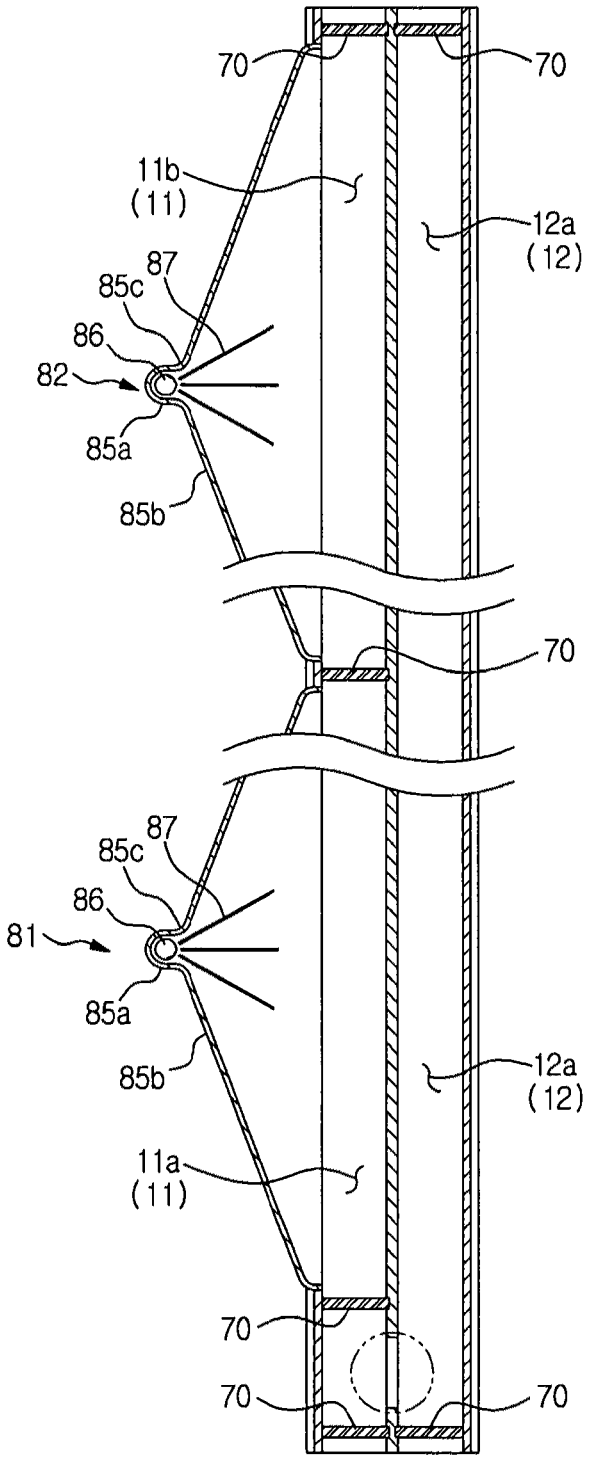

FIGS. 12 and 13 are sectional views illustrating a refrigerant introduction pipe according to another exemplary embodiment of the present disclosure. As shown in FIGS. 12 and 13, the refrigerant introduction pipes 81 and 82 may be coupled to the first header 11 of the first header unit 10 to form an integrated structure. That is, the refrigerant introduction pipes 81 and 82, which are made of an aluminum material, may be coupled to the first header 11 of the first header unit 10, which is made of an aluminum material through a brazing process.

Each of the refrigerant introduction pipes 81 and 82 may include a vertical portion 85*a*, a horizontal portion 85*b*, and a bent portion 85*c* to connect the vertical portion 85*a* and horizontal portion 85*b*.

The horizontal portion 85*b* of the first refrigerant introduction pipe 81 corresponds to the first tank 11*a* of the first header 11, whereas the horizontal portion 85*b* of the second refrigerant introduction pipe 82 corresponds to the second tank 11*b* of the first header 11.

The vertical portion 85*a* of each of the refrigerant introduction pipes 81 and 82 is connected to a refrigerant line (not shown) made of a copper material. Of course, a connecting pipe made of a stainless steel material may be interposed to prevent promoted corrosion of the different materials (the copper and aluminum materials) that may occur when the copper and aluminum materials come into contact with each other. Meanwhile, the vertical portion 85*a* has a smaller diameter than the horizontal portion 85*b*. In particular, this diameter difference is abrupt at the bent portion 85*c*. The bent portion 85 may function as a factor to obstruct smooth distribution of refrigerant because it abruptly changes the flow direction of the refrigerant from a vertical direction to a horizontal direction.

To this end, a diffusion member 86 is installed at a portion of the horizontal portion 85*b* adjacent to the vertical portion 85*a* in order to appropriately distribute the refrigerant flowing from the vertical portion 85*a* to the horizontal portion 85*b*. The diffusion member 86 may have a circular protrusion structure. Alternatively, the diffusion member 86 may be installed at a portion of the vertical portion 85*a* adjacent to the horizontal portion 85*b*.

A plurality of introduction pipe guide members 87 may be installed at the horizontal portion 85*b* to guide the refrigerant appropriately distributed by the diffusion member 86. The plural introduction pipe guide members 87 appropriately distribute the refrigerant to a corresponding one of the tanks 11*a* and 11*b* of the first header 11 in the first header unit 10. The refrigerant appropriately distributed in the corresponding one of the tanks 11*a* and 11*b* of the first header 11 in the first header unit 10 then flows to the tubes 31 of the first heat exchanging unit 30.

Figure 14:
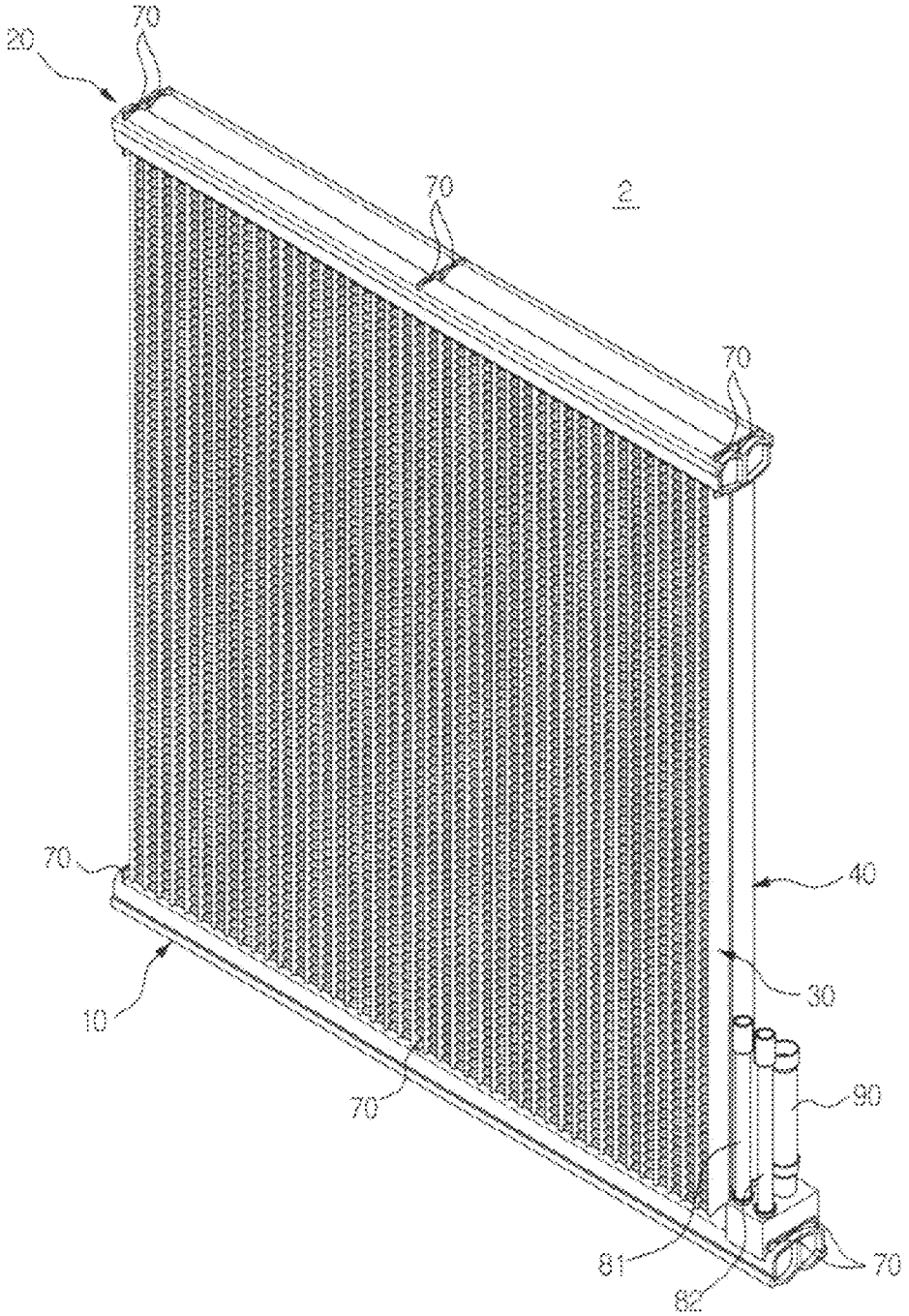
FIG. 14 is a perspective view illustrating a heat exchanger according to another exemplary embodiment of the present disclosure.
Figure 15:
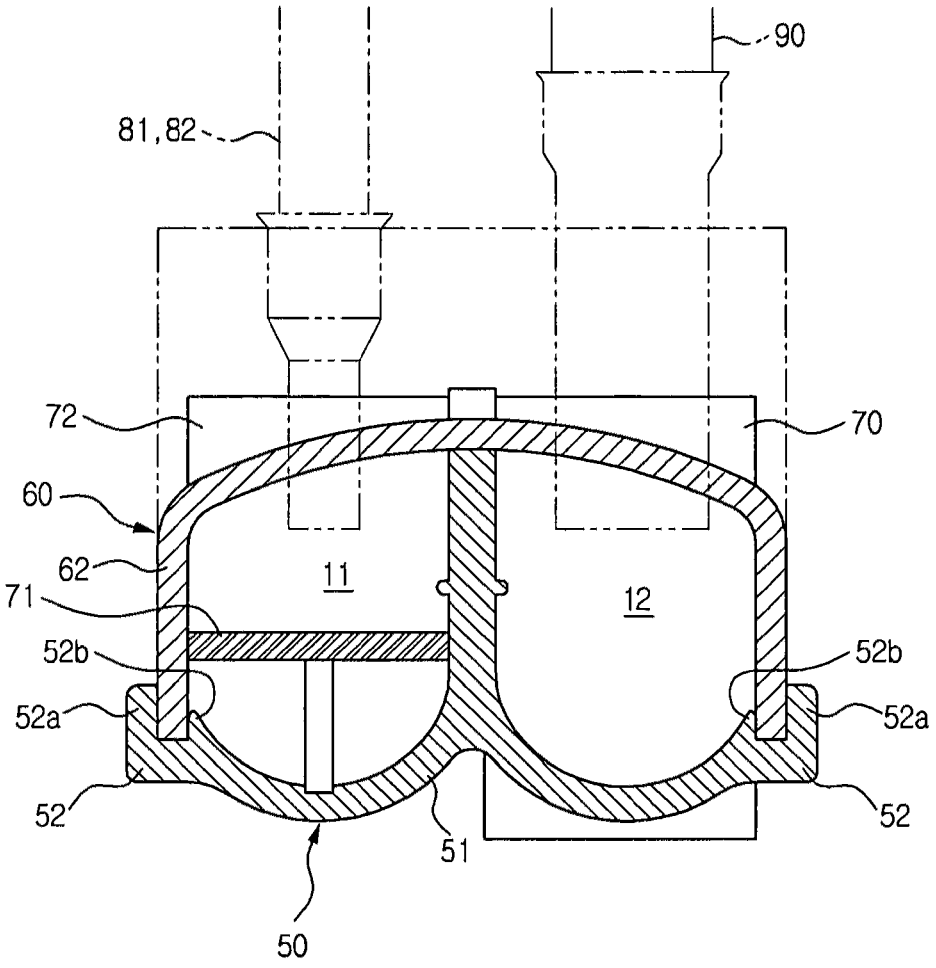
FIGS. 15 and 16 are sectional views illustrating a first structure of a first header unit included in the heat exchanger of FIG. 14.
Figure 16:
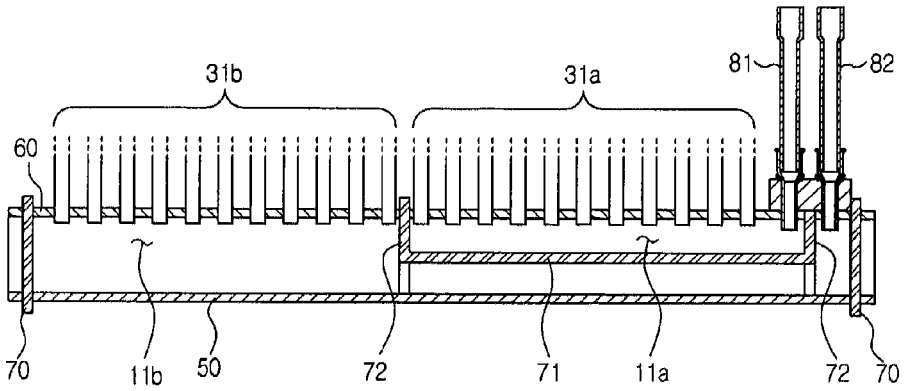

FIG. 14 is a perspective view illustrating a heat exchanger according to another exemplary embodiment of the present disclosure. FIGS. 15 and 16 are sectional views illustrating a first structure of a first header unit included in the heat exchanger of FIG. 14.

As shown in FIGS. 14 to 16, a plurality of refrigerant introduction pipes, for example, refrigerant introduction pipes 81 and 82, and a refrigerant discharge pipe 90 may be installed together at the right end of a heat exchanger 2.

A first header 11 included in a first header unit 10 communicates with the refrigerant introduction pipes 81 and 82. The first header 11 includes a first tank 11*a* to communicate with the first refrigerant introduction pipe 81, and a second tank 11*b* to communicate with the second refrigerant introduction pipe 82. The first and second tanks 11*a* and 11*b* are separated from each other by a horizontal partition plate 71 and vertical partition plates 72 provided at opposite sides of the horizontal partition plate 71. A group of tubes 31*a*, which define refrigerant paths, are connected to the first tank 11*a*. Also, a group of tubes 31*b*, which define refrigerant paths, are connected to the second tank 11*b*.

A second header 12 included in the first header unit 10 communicates with the refrigerant discharge pipe 90. The second header 12 includes a single tank 12*a* to communicate with the refrigerant discharge pipe 90.

Heretofore, the heat exchanger 2 shown in FIG. 14 has been described in conjunction with portions different from those of the heat exchanger 1 shown in FIG. 1. No description will be given of the same portions of the heat exchanger 2 of FIG. 14 as the heat exchanger 1 of FIG. 1.

Figure 17:
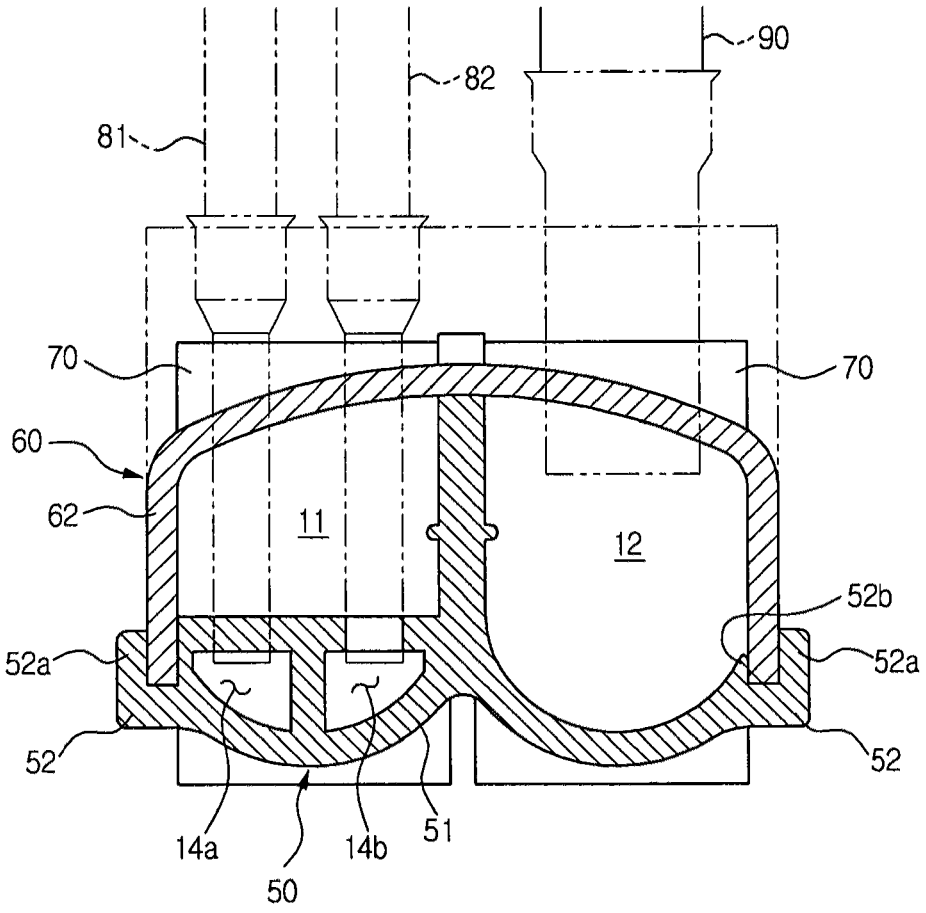
FIGS. 17 and 18 are sectional views illustrating a second structure of the first header unit included in the heat exchanger of FIG. 14.
Figure 18:
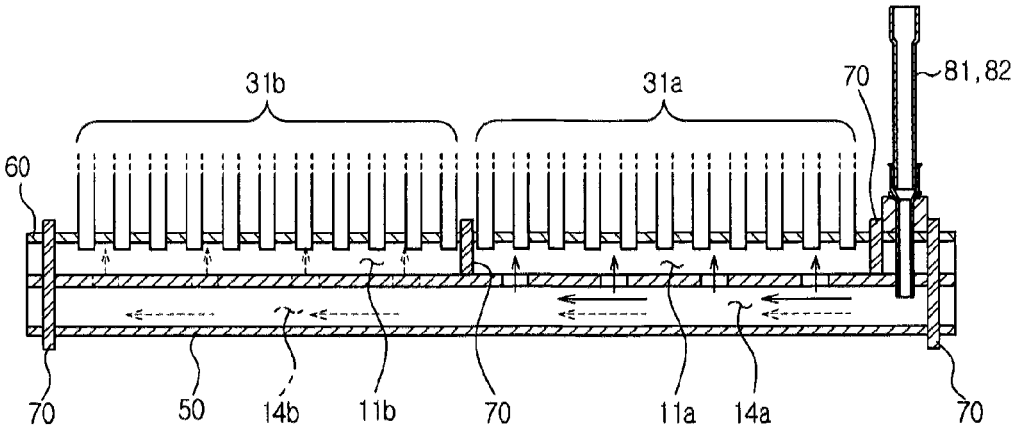

FIGS. 17 and 18 are sectional views illustrating a second structure of the first header unit included in the heat exchanger of FIG. 14.

As shown in FIGS. 14, 17, and 18, a plurality of refrigerant introduction pipes, for example, refrigerant introduction pipes 81 and 82, and a refrigerant discharge pipe 90 may be installed together at the right end of the heat exchanger 2.

A first header 11 included in a first header unit 10 communicates with the refrigerant introduction pipes 81 and 82. The first header 11 includes a first tank 11*a* to communicate with the first refrigerant introduction pipe 81, and a second tank 11*b* to communicate with the second refrigerant introduction pipe 82. The first and second tanks 11*a* and 11*b* are separated from each other by partition plates 70. The first header 11 also includes a first refrigerant passage 14*a* extending from the first refrigerant introduction pipe 81 to the first tank 11*a*, and a second refrigerant passage 14*b* extending from the second refrigerant introduction pipe 82 to the second tank 11*b*. The first and second refrigerant passages 14*a* and 14*b* are formed in accordance with an extrusion molding process.

A second header 12 included in the first header unit 10 communicates with the refrigerant discharge pipe 90. The second header 12 includes a single tank 12*a* to communicate with the refrigerant discharge pipe 90.

Heretofore, the heat exchanger 2 shown in FIG. 17 has been described in conjunction with portions different from those of the heat exchanger 1 shown in FIG. 1. No description will be given of the same portions of the heat exchanger 2 of FIG. 17 as the heat exchanger 1 of FIG. 1.

Hereinafter, operation and coupling of the heat exchanger according to an exemplary embodiment of the present disclosure will be described in conjunction with the accompanying drawings.

Figure 19:
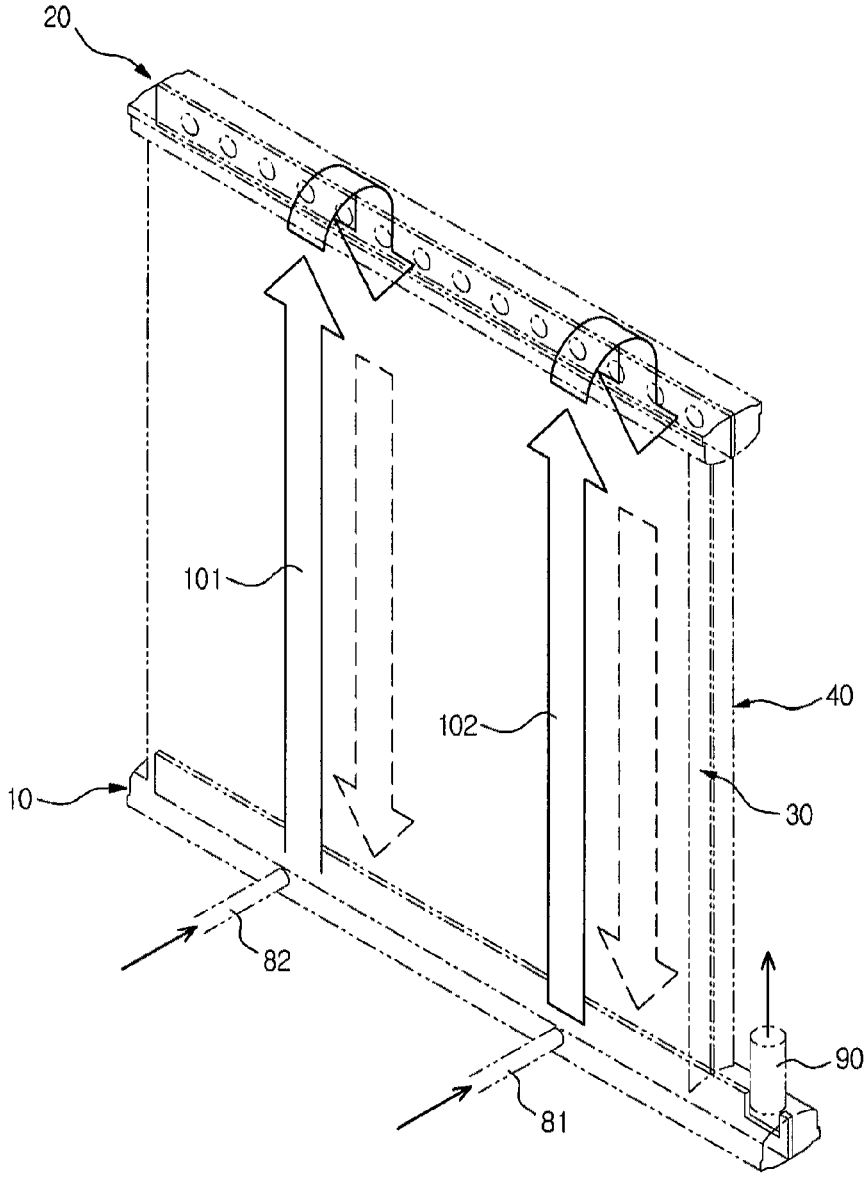
FIG. 19 is a schematic view illustrating refrigerant flows in the heat exchanger according to an exemplary embodiment of the present disclosure.

FIG. 19 is a schematic view illustrating refrigerant flows in the heat exchanger according to an exemplary embodiment of the present disclosure.

As shown in FIGS. 1 to 19, the heat exchanger includes a plurality of refrigerant circuits.

The plurality of refrigerant circuits may include a first refrigerant circuit 101 and a second refrigerant circuit 102. The first refrigerant circuit 101 is a refrigerant path through which refrigerant introduced into the first refrigerant introduction pipe 81 is discharged through the refrigerant discharge pipe 90 after passing through the first tank 11*a* of the first header 11, the grouped tubes 31 of the first heat exchanging unit 30, the first tank 21*a* of the third header 21, the first tank 22*a* of the fourth header 22, the grouped tubes 41 of the second heat exchanging unit 40, and the second header 12. The second refrigerant circuit 102 is a refrigerant path through which refrigerant introduced into the second refrigerant introduction pipe 82 is discharged through the refrigerant discharge pipe 90 after passing through the second tank 11*b* of the first header 11, the grouped tubes 31 of the first heat exchanging unit 30, the second tank 21*b* of the third header 21, the second tank 22*b* of the fourth header 22, the grouped tubes 41 of the second heat exchanging unit 40, and the second header 12.

As a plurality of refrigerant circuits, for example, the refrigerant circuits 101 and 102, are provided, it may be possible to achieve efficient refrigerant distribution, and thus to achieve an enhancement in heat exchange efficiency. Separate refrigerant flows may be defined in accordance with the provision of a plurality of refrigerant introduction pipes, for example, the refrigerant introduction pipes 81 and 82. Accordingly, even when the heat exchanger has an increased height, it may be possible to reliably supply refrigerant up to an uppermost portion of the heat exchanger, and thus to enhance operation reliability.

Since the second header 12, which is partitioned into the single tank 12*a*, communicates with the single refrigerant discharge pipe 90, it may be possible to simplify the structure of the second header 12 and the structure of the refrigerant discharge pipe 90. Also, the refrigerant discharge pipe 90 is arranged at one end of the first header unit 10. Accordingly, the heat exchanger has a compact structure.

Meanwhile, in accordance with another embodiment, each of the first header 11 of the first header unit 10 and the third header 21 and fourth header 22 of the second header unit 20 may be partitioned into a single tank. In this case, the heat exchanger may include a single refrigerant circuit.

In accordance with another embodiment, each of the first header 11 of the first header unit 10 and the third header 21 and fourth header 22 of the second header unit 20 may be partitioned into three or more tanks. In this case, the heat exchanger may include three or more refrigerant circuits.

In accordance with another embodiment, the first refrigerant circuit 101 and second refrigerant circuit 102 may have opposite refrigerant flow directions, respectively.

Meanwhile, the heat exchanger is made of an aluminum material. That is, the first header unit 10, second header unit 20, first heat exchanging unit 30, and second heat exchanging unit 40 are made of an aluminum material, and are coupled together through a brazing process.

In particular, in the case of a domestic heat exchanger, standard fracture pressure corresponds to 3 times maximum operating pressure. That is, the internal pressure design standard for refrigerant used in such a domestic heat exchanger, such as R-22 or R-410A, corresponds to 130-140 $kg/cm^2$ when the heat exchanger is used for cooling/heating. In order to satisfy this internal pressure design standard, the outer side wall portion 52*a* and inner side wall portion 52*b* of the body 50 are structured to simultaneously support the outer and inner surfaces of the side wall portion 62 of the cover 60. The heat exchanger also has a structure in which, when each partition plate 70 is coupled to the body 50 and cover 60, at least a portion of the partition plate 70 is fitted in the intermediate barrier wall 53. In addition, a cladding material is filled in the gap G between each tube 31 and the intermediate barrier wall 53 in the brazing process. Thus, the tube 31 may be firmly supported.

Meanwhile, the connecting pipes 83 and 91 are interposed between the first header unit 10, which is made of an aluminum material, and each of the refrigerant introduction pipes 81 and 82, which are made of a copper material, and between the first header unit 10 and the refrigerant discharge pipe 90, which is made of a copper material, respectively. Accordingly, it may possible to prevent promoted corrosion of the different materials (the copper and aluminum materials) that may occur when the copper and aluminum materials come into contact with each other. In addition, the reinforcing members 84 and 92 enclose each of the refrigerant introduction pipes 81 and 82 and the refrigerant discharge pipe 90, to firmly support the corresponding pipes, respectively.

As apparent from the above description, in accordance with one aspect of the present disclosure, it may be possible to provide a heat exchanger capable of achieving an improvement in refrigerant distribution, thereby achieving a remarkable enhancement in heat exchange efficiency.

Also, the heat exchanger may secure operation reliability and stiffness against refrigerant gas pressure while reducing manufacturing costs.

In addition, the heat exchanger may have a compact structure, so that the installation space thereof may be minimized. Thus, it may be possible to provide a compact air conditioner.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A heat exchanger comprising:

a first header unit including a body, a cover and an intermediate barrier wall to divide the first header unit into a first header and a second header;

a second header unit including a body, a cover and an intermediate barrier wall to divide the second header unit into a third header and a fourth header;

a first heat exchanging unit arranged between the first header of the first header unit and the third header of the second header unit; and a second heat exchanging unit arranged between the second header of the first header unit and the fourth header of the second header unit, wherein each of the first header of the first header unit and the third and fourth headers of the second header unit is partitioned into a plurality of sections by at least one partition plate, to define a plurality of refrigerant circuits, through which a plurality of refrigerant paths flows, and the second header of the first header unit has a single section, to allow refrigerant to flow in the second header of the first header unit in the form of a unified flow, wherein the first header of the first header unit communicates with a plurality of refrigerant introduction pipes, and the second header of the first header unit communicates with a single refrigerant discharge pipe, wherein the refrigerant discharge pipe is arranged at a longitudinal end of the first header unit, and wherein a portion of the intermediate barrier wall is partially removed from a region immediately adjacent the refrigerant discharge pipe whereby the first and second headers of the first header unit, communicate with each other in the region to reduce flow resistance of the refrigerant.

2. The heat exchanger according to claim 1, wherein each of the plural partitioned sections in each of the first header of the first header unit and the third header of the second header unit is connected with a group of tubes included in the first heat exchanging unit.

3. The heat exchanger according to claim 2, wherein each of the tubes includes a plurality of microchannels.

4. The heat exchanger according to claim 1, wherein each of the plural partitioned sections in the fourth header of the second header unit is connected with a group of tubes included in the second heat exchanging unit; and the single section in the second header of the first header unit is connected to an entirety of tubes included in the second heat exchanging unit.

5. The heat exchanger according to claim 1, wherein the first header unit, the second header unit, the first heat exchanging unit and the second heat exchanging unit are made of an aluminum material, and the refrigerant introduction pipe is made of a copper material.

6. The heat exchanger according to claim 5, wherein a connecting pipe made of a stainless steel material is arranged between each of the plural refrigerant introduction pipes made of the copper material and the first header unit made of the aluminum material.

7. The heat exchanger according to claim 1, wherein the first header unit, the second header unit, the first heat exchanging unit and the second heat exchanging unit are made of an aluminum material, and the refrigerant discharge pipe is made of a copper material.

8. The heat exchanger according to claim 7, wherein a connecting pipe made of a stainless steel material is arranged between the refrigerant discharge pipe made of the copper material and the first header unit made of the aluminum material.

9. The heat exchanger according to claim 1, wherein the first and second header units are horizontally arranged, and the first and second heat exchanging units are vertically arranged.

10. The heat exchanger according to claim 1, wherein the first header unit body supports the first header unit cover by outer and inner sides of the first header unit body in a simultaneous manner.

11. The heat exchanger according to claim 1, wherein a plurality of through holes is formed through the second header unit intermediate barrier wall, to communicate the third and fourth headers with each other.

12. The heat exchanger according to claim 1, wherein the second header unit body supports the second header unit cover by outer and inner sides of the second header unit body in a simultaneous manner.

13. The heat exchanger according to claim 1, wherein each of the heat exchanging units includes fins having a corrugated structure, and each of the fins has louvers.

14. The heat exchanger according to claim 1, wherein the at least one partition plate is configured so that an upper portion of the at least one partition plate extends through the cover, a lower portion of the at least one partition plate extends through the body, and at least a portion of the at least one partition plate is fitted in the intermediate barrier wall of each of the first header unit and the second header unit to increase a stiffness of the partition plate, and wherein the at least one partition plate does not penetrate through the intermediate barrier wall.

15. A heat exchanger comprising: first and second header units; and first and second heat exchanging units arranged between the first and second header units, each of the first and second heat exchanging units including a plurality of fins and a plurality of tubes, wherein at least a portion of the first header unit is partitioned into a plurality of tanks respectively connected to a plurality of refrigerant introduction pipes, to allow refrigerant to flow in the first heat exchanging unit while forming a plurality of refrigerant blocks, wherein the second header unit is partitioned into a plurality of tanks to respectively define a plurality of connecting passages, so as to allow refrigerant to flow in the second heat exchanging unit while forming a plurality of refrigerant blocks, wherein at least a remaining portion of the first header unit is partitioned into a single tank connected to a single refrigerant discharge pipe, wherein the plurality of refrigerant introduction pipes and the refrigerant discharge pipe are arranged together at a longitudinal end of the first header unit, wherein the plurality of refrigerant introduction pipes are installed at respective tanks of the first header unit, wherein the first header unit includes a first header connected to the first heat exchanging unit, and a second header connected to the second heat exchanging unit, the first header of the first header unit is partitioned into the plural tanks respectively connected to the refrigerant introduction pipes by a plurality of partition plates, and the second header of the first header unit is partitioned into the single tank connected to the refrigerant discharge pipe by a plurality of partition plates, and wherein at least one of the partition plates in a region immediately adjacent the refrigerant discharge pipe is partially removed whereby the first and second headers of the first header unit communicate with each other in the region to reduce flow resistance of the refrigerant.

16. The heat exchanger according to claim 15, wherein each of the plural tanks in the first header of the first header unit is connected to a group of tubes included in the plural tubes of the first heat exchanging unit; and the tank in the second header of the first header unit is connected to an entirety of the plural tubes of the second heat exchanging unit.

17. The heat exchanger according to claim 15, wherein the second header unit includes a first header connected to the first heat exchanging unit, and a second header connected to the second heat exchanging unit;

the first header of the second header unit is partitioned into a group of tanks included in the plural tanks of the second header unit by a plurality of partition plates, and each of the tanks in the first header is connected to a group of tubes included in the plural tubes of the first heat exchanging unit; and the second header of the second header unit is partitioned into a group of tanks included in the plural tanks of the second header unit by a plurality of partition plates, and each of the tanks in the second header is connected to a group of tubes included in the plural tubes of the second heat exchanging unit.

18. The heat exchanger according to claim 15, wherein the first header unit, the second header unit, the first heat exchanging unit and the second heat exchanging unit are made of an aluminum material, and the refrigerant introduction pipes and the refrigerant discharge pipe are made of a copper material; and a first connecting pipe made of a stainless steel material is arranged between each of the refrigerant introduction pipe made of the copper material and the first header unit made of the aluminum material, and a second connecting pipe made of a stainless steel material is arranged between the refrigerant discharge pipe made of the copper material and the first header unit made of the aluminum material.

* * * * *